United States Patent [19]

Segoshi

[11] Patent Number: 4,894,585

[45] Date of Patent: Jan. 16, 1990

[54] COMBINATION LAMP

[75] Inventor: Toru Segoshi, Kanagawa, Japan

[73] Assignee: Nissan Motor Company, Limited, Japan

[21] Appl. No.: 945,679

[22] Filed: Dec. 23, 1986

[30] Foreign Application Priority Data

Feb. 25, 1986 [JP] Japan ..... 61-38338

[51] Int. Cl.[4] ..... H01J 61/52

[52] U.S. Cl. ..... 315/112; 315/83; 315/178

[58] Field of Search ..... 315/82, 83, 178, 179, 315/112

[56] References Cited

U.S. PATENT DOCUMENTS

| | | | |
|---|---|---|---|
| 3,445,719 | 5/1969 | Thouret et al. | 315/179 |
| 3,527,982 | 9/1970 | Lake | 315/179 |
| 3,723,808 | 3/1973 | Jones | 315/178 |
| 4,350,930 | 9/1982 | Peil et al. | 315/178 |
| 4,358,713 | 11/1982 | Senoo et al. | 315/178 |
| 4,438,369 | 3/1984 | Hicks et al. | 315/179 |
| 4,513,357 | 4/1985 | Nieda et al. | 315/83 |
| 4,645,974 | 2/1987 | Asai | 315/112 |

*Primary Examiner*—Robert L. Griffin
*Assistant Examiner*—T. Salindong
*Attorney, Agent, or Firm*—Lowe, Price, Leblanc, Becker & Shur

[57] ABSTRACT

A combination lamp includes a first light and a second light. The first light includes a discharge lamp and serves to generate light. The second light serves to generate light and also heat, and thereby serves to heat the discharge lamp. Accordingly, the second light can preheat the discharge lamp. This preheating allows the discharge lamp to produce adequate luminous energy immediately when the discharge lamp is turned on.

11 Claims, 3 Drawing Sheets

COMBINATION LAMP

BACKGROUND OF THE INVENTION

1. Field of the Invention

This invention relates to a combination lamp, such as a vehicle combination front light.

2. Description of the Prior Art

In general, discharge lamps are superior in efficiency and luminance to filament lamps. A light emitting tube of the discharge lamp produces inadequate luminous energy at low temperatures. The luminous energy from the light emitting tube is acceptable at high temperatures.

Some automotive headlights include discharge lamps. Japanese published unexamined patent application No. 60-84702 discloses an advanced headlight of this type. In this advanced headlight, heat insulating members serve to reduce the rate of the escape of heat from the light emitting tube in a discharge lamp. The reduction of the heat escape rate speeds up increases in the temperature of the light emitting tube after the discharge lamp is turned on. Accordingly, the light emitting tube can produce adequate luminous energy within a shortened time after the discharge lamp is turned on.

SUMMARY OF THE INVENTION

It is an object of this invention to provide a compact or simple combination lamp.

It is another object of this invention to provide a combination lamp including a discharge lamp which can produce adequate luminous energy within a shorter time from its activation than available heretofore.

In accordance with this invention, a combination lamp includes a first light and a second light. The first light includes a discharge lamp and serves to generate light. The second light serves to generate light and also heat, and thereby serves to heat the discharge lamp.

BRIEF DESCRIPTION OF THE DRAWINGS

Like and corresponding elements are denoted by the same reference characters throughout the drawings.

DESCRIPTION OF THE FIRST PREFERRED EMBODIMENT

Figure 1:
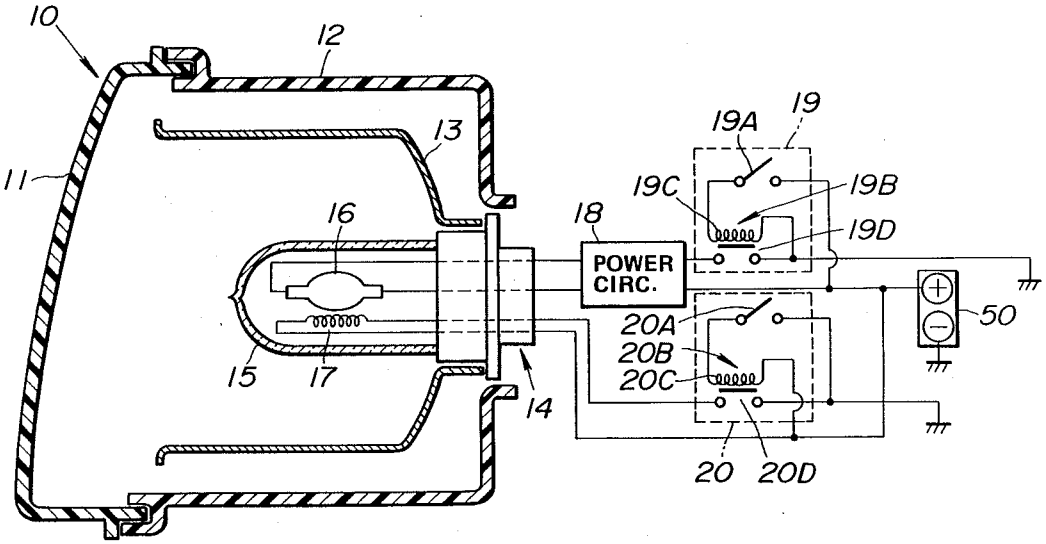
FIG. 1 includes a sectional view of an automotive combination lamp and a schematic diagram of an electrical circuit according to a first embodiment of this invention.

With reference to FIG. 1, an automotive front combination lamp 10 includes a headlight and a second light, such as a side light. The combination lamp 10 has a lens 11 and a housing 12. The lens 11 is attached to the housing 12 in such a manner as to close an open front end of the housing 12. The housing 12 is fixed to a front of a vehicle body.

The headlight includes a discharge lamp 14 which has a light emitting tube 16 fixedly disposed within a sealed outer tube 15. The outer tube 15 preferably contains inert gas. Light from the device 16 passes through the outer tube 15. The outer tube 5 is fixedly accommodated in the housing 12.

The second light includes a filament 17 fixedly disposed in the region within the outer tube 15 near the light emitting tube 16. When the filament 17 is activated, it generates light and also heat. Since the filament 17 is close to the light emitting tube 16, the filament 17 can effectively heat the tube 16. Light from the filament 17 passes through the outer tube 15.

A reflector 13 supported on a base of the outer tube 15 extends around the outer tube 15. The reflector 13 is exposed to lights from the light emitting tube 16 and the filament 17. The reflector 13 changes directions of movement of the lights toward the lens 11.

The light emitting tube 16 is electrically connected to output terminals of a power supply circuit 18 by conductive wires extending through the base of the outer tube 15. The conductive wires also support the light emitting tube 16 on the base of the outer tube 15. Input terminals of the power supply circuit 18 are electrically connected to a power supply 50 via a switch circuit 19.

The switch circuit 19 includes a manual switch 19A and a relay 19B. The manual switch 19A and a control winding 19C of the relay 19B are electrically connected in series with the power supply 50. A switch 19D of the relay 19B is electrically connected between the power supply circuit 18 and the power supply 50. When the manual switch 19A is closed, the relay winding 19C is energized so that the relay switch 19D is closed. This allows electrical power to be fed to the power supply circuit 18 from the power supply 50. When the manual switch 19A is opened, the relay winding 19C is de-energized so that the relay switch 19D is opened. This interrupts the feed of the electrical power to the power supply circuit 18. The manual switch 19A is preferably located on an instrument panel within the vehicle.

The power supply circuit 18 is designed in a conventional manner, including a ballast and a high voltage lighting circuit. The power supply circuit 18 derives a high tension electrical power from the input electrical power. The high tension electrical power activates the light emitting tube 16. When the manual switch 19A is closed so that the electrical power is fed to the power supply circuit 18, the circuit 18 generates the high tension electrical power which activates the light emitting tube 16. When the manual switch 19A is opened so that the feed of the electrical power to the power supply circuit 18 is interrupted, the high tension electrical power becomes absent and thus the light emitting tube 16 is deactivated.

The filament 17 is electrically connected across the power supply 50 via conductive wires extending through the base of the outer tube 15. The conductive wires also support the filament 17 on the base of the outer tube 15. A switch circuit 20 is disposed in the electrical connection between the filament 17 and the power supply 50.

The switch circuit 20 includes a manual switch 20A and a relay 20B. The manual switch 20A and a control winding 20C of the relay 20B are electrically connected in series with the power supply 50. A switch 20D of the relay 20B is electrically connected between the filament 17 and the power supply 50. When the manual switch 20A is closed, the relay winding 20C is energized so that the relay switch 20D is closed. This allows electrical power to be fed to the filament 17 from the power supply 50 so that the filament 17 is activated. When the manual switch 20A is opened, the relay winding 20C is de-energized so that the relay switch 20D is opened. This interrupts the feed of the electrical power to the filament 17 so that the filament 17 is deactivated. The manual switch 20A is preferably located on the instrument panel within the vehicle.

In general, the side lights are activated before the headlights are activated. Accordingly, in the case where the second light including the filament 17 consists of a side light, the filament 17 usually preheats the light emitting tube 16 of the discharge lamp 14 constituting the headlight. Since the light emitting tube 16 is preheated in this way, the tube 16 can produce adequate luminous energy immediately when it is lighted. Thus, the headlight can operate acceptably as soon as it is turned on.

In the case where the headlight and the second light are simultaneously turned on so that the light emitting tube 16 and the filament 17 are lighted at the same time, the filament 17 heats the tube 16 after the activation of the filament 17 so that the tube 16 can produce adequate luminous energy immediately after it is lighted.

In the case where the second light including the filament 17 consists of a daylight running lamp which is legally required to be lighted during operation of the vehicle engine in some countries, the filament 17 continuously heats the light emitting tube 16 during operation of the engine. This heating allows the tube 16 to produce adequate luminous energy immediately upon activation of the tube 16.

DESCRIPTION OF THE SECOND PREFERRED EMBODIMENT

Figure 2:
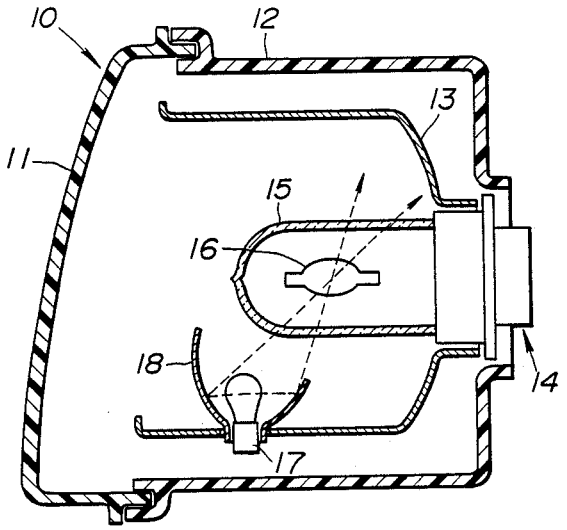
FIG. 2 is a sectional view of an automotive combination lamp according to a second embodiment of this invention.
Figure 3:
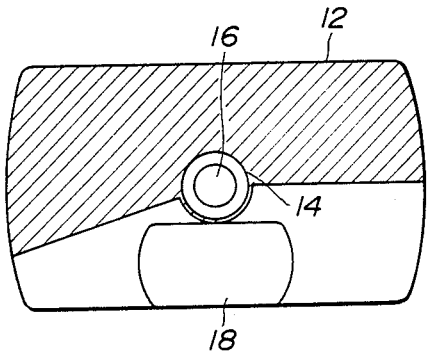
FIG. 3 is a front view of the automotive combination lamp of FIG. 2.

FIGS. 2 and 3 show a second embodiment of this invention, which is similar to the embodiment of FIG. 1 except for the following design changes.

As shown in FIG. 2, a second light includes a bulb 17 replaceably mounted on a reflector 13 and disposed in the region within a housing 12 outside an outer tube 15 of a discharge lamp 14. Accordingly, the bulb 17 can be replaced independent of the discharge lamp 14. The location of the bulb 17 is lower than and frontward of the position of the light emitting tube 16. The bulb 17 contains a filament (not shown) serving to generate light and heat. The second light preferably consists of a side light, a dim light, or a low beam light.

A reflector 18 mounted on the reflector 13 surrounds the bulb 17. The reflector 18 concentrates heat from the bulb 17 on the light emitting tube 16 of the discharge lamp 14 so that the tube 16 can be effectively heated by the bulb 17.

Directions of movement of lights from the bulb 17 are changed by the reflector 18 toward essentially the upper half of the reflector 13, so that the hatched area in FIG. 3 shines when the bulb 17 is lighted. This shine is suitable for a dim light or a low beam light.

DESCRIPTION OF THE OTHER PREFERRED EMBODIMENTS

Figure 4:
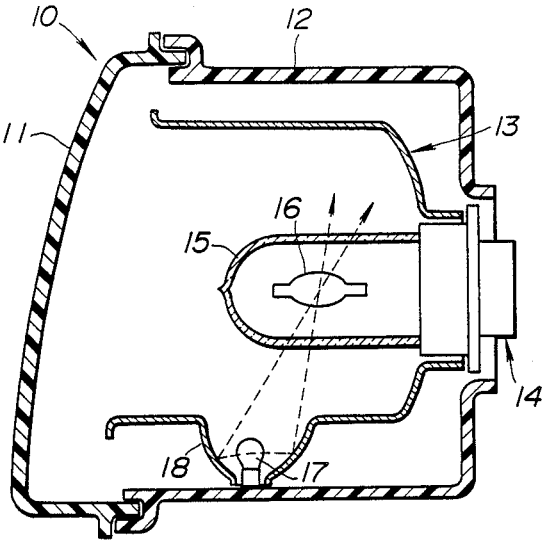
FIG. 4 is a sectional view of an automotive combination lamp according to a third embodiment of this invention.

FIG. 4 shows a third embodiment of this invention, which is similar to the embodiment of FIGS. 2 and 3 except for the design change as follows. A reflector 18 is integral with a reflector 13. Specifically, a lower portion of the reflector 13 has a recess defined by the reflector 18. The bulb 17 is disposed in the recess.

Figure 5:
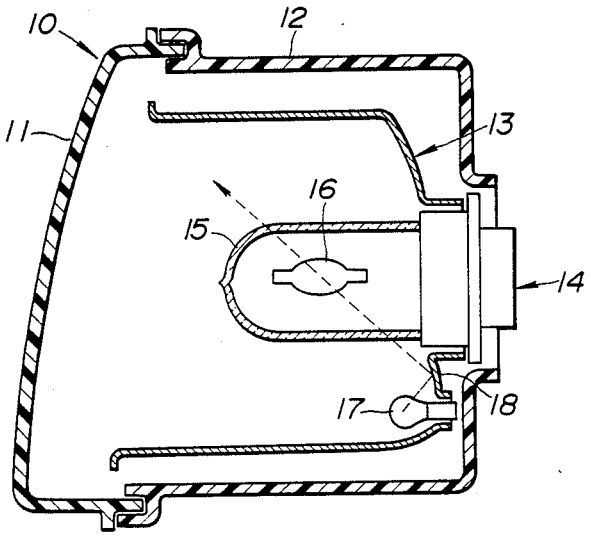
FIG. 5 is a sectional view of an automotive combination lamp according to a fourth embodiment of this invention.

FIG. 5 shows a fourth embodiment of this invention, which is similar to the embodiment of FIG. 4 except for locations of a bulb 17 and a reflector 18. As shown in FIG. 5, the reflector 18 is located at a lower portion of a rear of a reflector 13. The bulb 17 extends in front of the reflector 18. A portion of lights from the bulb 17 directly move toward the lens 11.

What is claimed is:

1. An automotive headlight, comprising:
(a) first means, including a high intensity discharge lamp, for generating and emitting a high intensity light; and
(b) second means including a filament selectively operable independently of said first means for generating and emitting light and positioned close enough to said discharge lamp whereby said filament can preheat said discharge lamp.

2. The automotive headlight of claim 1 wherein the discharge lamp includes a light emitting tube, and the light emitting tube and the filament are disposed within a common outer bulb.

3. The automotive headlight of claim 1 further comprising means for concentrating heat from the filament on the discharge lamp.

4. The automotive headlight of claim 3 further comprising a first reflector acting on light from the discharge lamp, and wherein the heat concentrating means includes a second reflector integral with the first reflector.

5. The automotive headlight of claim 1 wherein the first means comprises an automotive headlight and the second means comprises an automotive side light, which is usually turned on before the headlight is turned on so that the discharge lamp is generally preheated by the second means.

6. An automotive headlight system comprising:
(a) a headlight including a high intensity discharge lamp operable to generate a light beam; and
(b) a light source including a filament selectively operable independently of said headlight for generating light and also heat and positioned close enough to said discharge lamp whereby said discharge lamp can be preheated by said filament.

7. The headlight system of claim 6 wherein the second light comprises a side light.

8. The headlight system of claim 6 wherein the second light comprises a dim light.

9. The headlight system of claim 6 wherein the second light is continuously activated during operation of an automotive engine.

10. An automotive headlight system comprising:
(a) a high intensity discharge lamp operable for emitting a high intensity beam of light;
(b) an auxiliary incandescent lamp located proximate to, and selectively operable independently of, said high intensity discharge lamp for emitting and radiating light and heat energy; and
(c) a heat reflector for concentrating said heat energy from said auxiliary incandescent lamp onto said high intensity discharge lamp to preheat said high intensity discharge lamp.

11. The headlight system of claim 10, further comprising a first manually operable switch for supplying electrical power to aid high intensity discharge lamp and a second manually operable switch for supplying electrical power to said auxiliary incandescent lamp independent of said first switch.

* * * * *